US009615640B2

(12) United States Patent
Westphal

(10) Patent No.: US 9,615,640 B2
(45) Date of Patent: Apr. 11, 2017

(54) PERSONAL ITEMS RETRIEVAL SYSTEM

(71) Applicant: FINDER ENTERPRISES, LLC, Exton, PA (US)

(72) Inventor: Rainer J. Westphal, Devon, PA (US)

(73) Assignee: FINDER ENTERPRISES, LLC, Exton, PA (US)

( * ) Notice: Subject to any disclaimer, the term of this patent is extended or adjusted under 35 U.S.C. 154(b) by 25 days.

(21) Appl. No.: 14/686,187

(22) Filed: Apr. 14, 2015

(65) Prior Publication Data

US 2015/0289618 A1 Oct. 15, 2015

Related U.S. Application Data

(60) Provisional application No. 61/979,822, filed on Apr. 15, 2014.

(51) Int. Cl.

| | |
|---|---|
| ***A45C 11/16*** | (2006.01) |
| *A45C 11/00* | (2006.01) |
| *B42F 7/10* | (2006.01) |

(52) U.S. Cl.

CPC ..... *A45C 11/16* (2013.01); *A45C 2011/002* (2013.01); *A45C 2200/05* (2013.01); *A45C 2200/10* (2013.01); *B42F 7/10* (2013.01)

(58) Field of Classification Search

CPC ..... A45C 11/16; A45C 13/02; A45C 2200/05; A45C 2200/10; A45C 2011/002; A47B 47/021; A47B 47/04; B42F 17/00; A47F 5/00

USPC ..... 206/38; 220/507, 552–555, 23.4, 23.83, 220/694, 751; 211/10, 11, 13.1, 134, 153, 211/188, 186; 312/107, 108; 248/312.1

See application file for complete search history.

(56) References Cited

U.S. PATENT DOCUMENTS

| | | | | | |
|---|---|---|---|---|---|
| 3,070,234 | A | * | 12/1962 | Deitchman | A47B 57/40 211/10 |
| 3,107,012 | A | * | 10/1963 | Rothenborg | A47B 63/02 211/11 |
| 3,552,817 | A | * | 1/1971 | Marcolongo | A47B 87/02 312/107 |
| 4,192,439 | A | * | 3/1980 | Segal | A47J 47/08 220/507 |
| 4,413,745 | A | * | 11/1983 | Stroud | A47G 23/0633 220/23.4 |

(Continued)

FOREIGN PATENT DOCUMENTS

GB 1079678 A * 8/1967 ..... A47B 87/0269

*Primary Examiner* — Bryon Gehman

(74) *Attorney, Agent, or Firm* — MH2 Technology Law Group LLP

(57) ABSTRACT

A personal items retrieval system including, at least, a first receptacle for receiving a specific first personal item, a first receptacle label that identifies the specific first personal item, a second receptacle for receiving a specific second personal item, and a second receptacle label that identifies the specific second personal item. Including an individual, separate receptacle as well as a label for a specific item on each receptacle provides a visual cue that an item may be misplaced, for example before the owner needs the item. Each specific personal item is uniquely paired with a receptacle and a label, thereby providing a convenient indication of whether the specific personal item is within its designated location, or whether the specific personal item may need to be located.

13 Claims, 2 Drawing Sheets

(56) References Cited

U.S. PATENT DOCUMENTS

| | | | | | |
|---|---|---|---|---|---|
| 5,316,249 | A * | 5/1994 | Anderson | H01H 9/025 | 211/26.1 |
| 5,823,359 | A * | 10/1998 | Harris | B42F 7/12 | 211/11 |
| 6,092,672 | A * | 7/2000 | Harris | B42F 7/10 | 211/11 |
| 8,157,109 | B2 * | 4/2012 | Zu | A47B 43/003 | 211/55 |
| 8,925,745 | B2 * | 1/2015 | Theisen | A47F 5/0043 | 211/10 |
| 2006/0011564 | A1 * | 1/2006 | Hatzis | A47B 63/00 | 211/10 |
| 2006/0196837 | A1 * | 9/2006 | Dao | A47G 23/0216 | 211/11 |
| 2006/0201895 | A1 * | 9/2006 | Jackson | H01H 9/025 | 211/13.1 |

* cited by examiner

PERSONAL ITEMS RETRIEVAL SYSTEM

PRIORITY

This application claims the benefit of U.S. Provisional Application No. 61/979,822, filed on Apr. 15, 2014.

TECHNICAL FIELD

The present, teachings relate to the field of storage containers and personal organizers. More particularly, the present teachings relate to storage containers for organizing and storing specific personal items.

BACKGROUND

Specific personal items including a wallet, keys, cell phone, wrist watch, eyeglasses, and a day planner are typically transported in one or more pockets or a purse during daily activities. In the home these items are easily and commonly misplaced. Many times one does not realize that the item is missing until it is needed at which time a search is conducted, often under time constraints.

A container that reduces the likelihood of misplacing one or more specific common personal items would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment, a personal organizer may include a first receptacle for receiving a specific first personal item, a first receptacle label that identifies the specific first item, a second receptacle for receiving a specific second personal item, and a second receptacle label that identifies the specific second item.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As discussed above, a variety of personal items such as a wallet, keys, cell phone, wrist watch, day planner, and eyeglasses are easily and commonly misplaced in the home. Many times one does not realize that the item is missing until it is needed, at which time a search is conducted at locations where the lost item is typically left. The search for the misplaced item is often conducted under the pressure of an upcoming meeting.

An embodiment of the present teachings provides a visual cue or reminder that an item is misplaced, such that the owner may locate the misplaced item before it is needed. The visual cue is provided in part by a label on a personal items retrieval system (personal organizer) that includes a plurality of storage receptacles, shelves, or bins, wherein each receptacle is labeled for a specific personal item. The container increases the likelihood that a user will notice that an item is not in its proper location before it is needed. A quick glance of the organizer will immediately alert the user that an item is present or missing from its location on or within the organizer.

Figure 1:
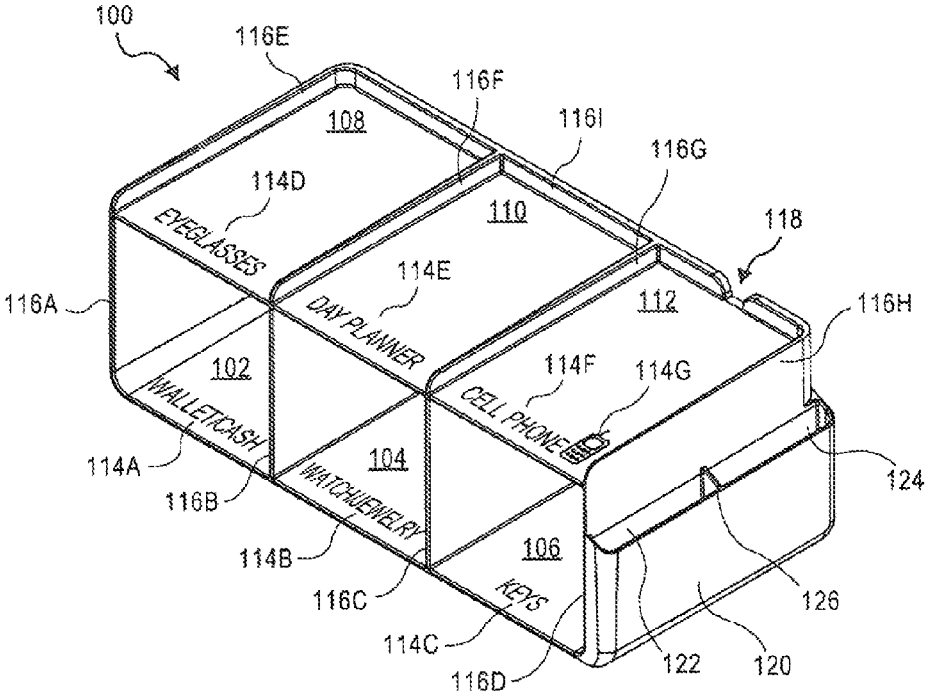
FIG. 1 is a schematic perspective depiction of an embodiment of a personal items retrieval system (personal organizer) according to the present teachings.

FIG. 1 is a perspective depiction of an organizer 100 in accordance with an embodiment of the present teachings. This embodiment includes a plurality of lower shelves or receptacles 102, 104, 106 and a plurality of upper shelves or receptacles 108, 110, 112. Floors of the upper receptacles provide ceilings for the lower receptacles. In an embodiment, the lower receptacles 102-106 may be enclosed on either four sides (top, bottom, left, and right), or on five sides if the organizer 100 includes a back 300 (FIG. 3) that provides a back surface.

Each of the receptacles 102-112 are labeled with an identifier 114A-114F for a specific personal item. As depicted in FIG. 1, the lower shelves 102-106, from left to right, are labeled "WALLET/CASH" (corresponding to "wallet and/or cash") 114A, "WATCH/JEWELRY" (corresponding to "watch and/or jewelry") 114B, and "KEYS" 114C, while the upper shelves 108-112 are labeled "EYEGLASSES" 114D, "DAY PLANNER" 114E, and "CELL PHONE" 114F. Various other personal effects and/or identifying labels are contemplated. While FIG. 1 depicts labels 114A-114F including alphabetical characters, it will be appreciated that iconic or graphical labels or indicia 114G may be used instead of, or in addition to, the alphabetical labels, for example to accommodate various languages and countries. Each lower and upper receptacle 102-112 may be separated from an adjacent lower or upper receptacle by a lip, wall, or divider 116A-116I. In an embodiment, the lower dividers 116A-116D that separate and define the lower receptacles 102-106 from an adjacent lower receptacle are continuous with the upper dividers 116E-116H that separate the upper receptacles 108-112 from an adjacent upper receptacle.

Including an individual, separate receptacle as well as a label for a specific item on each receptacle provides a visual cue that an item may be misplaced, for example before or when the owner needs the item. Each specific item is uniquely paired with both a receptacle and a label, thereby providing a convenient indication of whether the specific item is within its designated location. If an item is missing, it is immediately evident to the user that the item called out by the label is not present in its uniquely paired receptacle. The user is thereby more likely to notice that an item is not in its designated receptacle before it is needed. This is in contrast to an organizer with non-labeled shelves, which provides no visual cue that a specific item may be missing.

An embodiment of the present teachings may include various other features. For example, an embodiment may include a cell phone cord notch 118 in the lip 116I of the receptacle 112 that is designated for a cell phone. The notch 118 is configured to receive and position a cell phone power cord to facilitate charging of a cell phone while stored within the receptacle 112. Additionally, an embodiment may include one or more vertically oriented receptacles 120 that may be configured to receive and store one or more items such as pens, pencils, note pads, or other items at the discretion of the user. Each vertically oriented receptacle 120 may include one or more vertically oriented slots 122, 124 separated by a divider 126 as depicted.

In an embodiment, an organizer may be manufactured from an opaque material. In another embodiment, an organizer may be manufactured from a translucent or transparent material to more easily identify whether the specific personal item is located within its designated receptacle.

In an embodiment as depicted in FIG. 1, an organizer 100 may be manufactured as a single piece of material, for example plastic, metal, a polymer such as polycarbonate, etc using, for example, injection molding. In another embodiment, an organizer 100 may be manufactured as a plurality of individual sections that are assembled by the manufacturer, seller, or consumer. The plurality of sections may be manufactured using one or more of, for example, injection molding, stamping, laser cutting, water jet cutting, sawing, etc. Shipping the organizer as a plurality of individual, discrete sections may, for example, reduce manufacturing and/or shipping costs. While FIG. 1 depicts six receptacles and six labels, where each label is uniquely paired with one of the six receptacles, other embodiments are contemplated.

Figure 2:
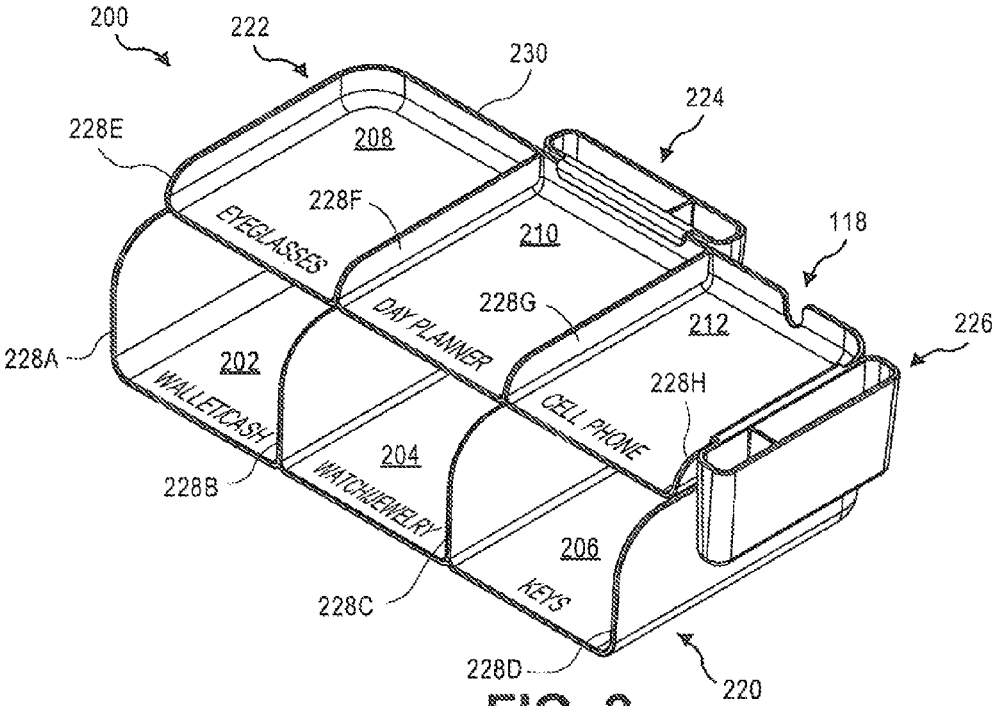
FIG. 2 is an exploded perspective depiction.
Figure 3:
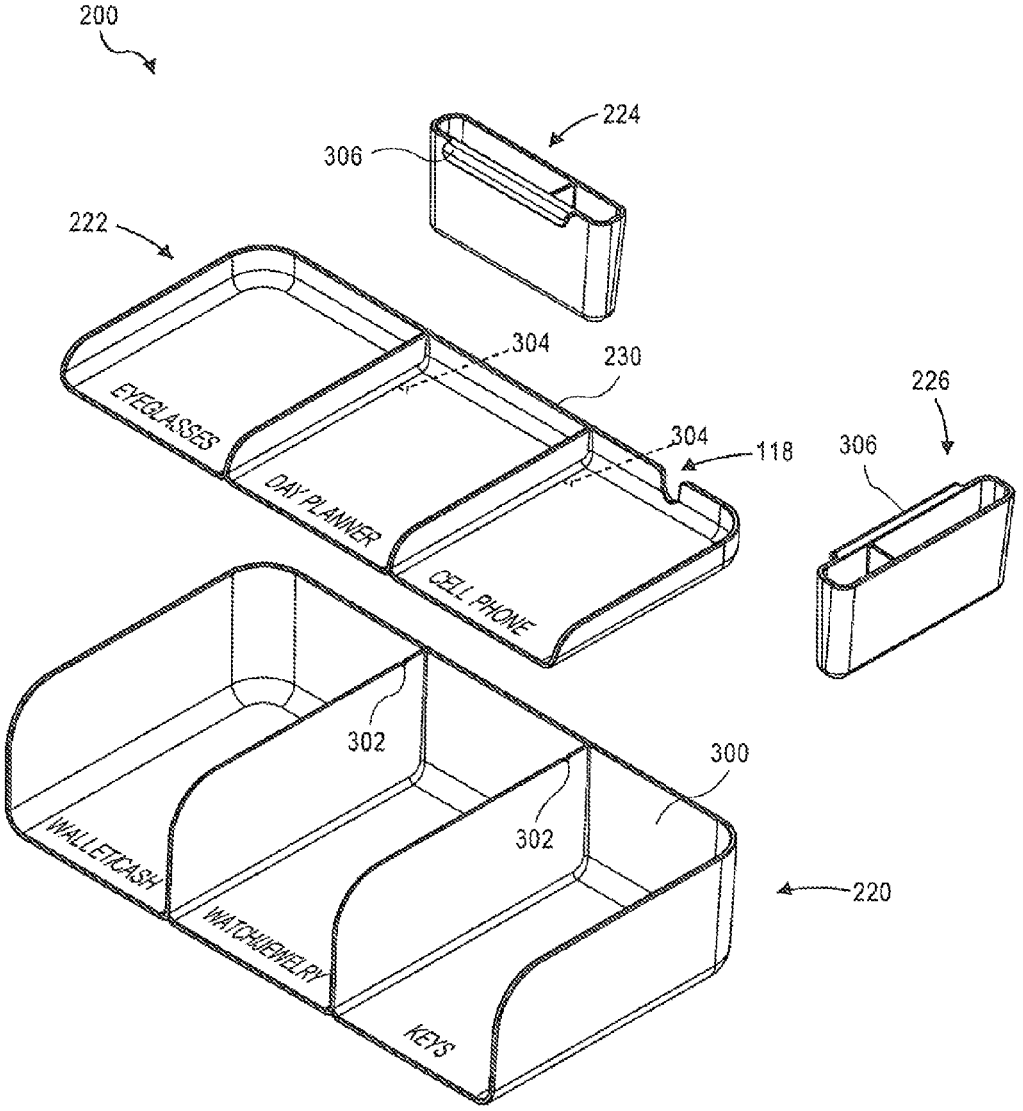
FIG. 3 is an assembled perspective depiction of FIG. 2, of a modular personal items retrieval system in accordance with an embodiment of the present teachings.

FIG. 2 is an assembled perspective depiction, and FIG. 3 is an exploded perspective depiction, of a modular design for a personal items retrieval system 200. In this embodiment, various elements may be separately formed and then stacked and/or assembled by the manufacturer or the user to form a completed organizer. As depicted in the perspective depiction of FIG. 2 and the exploded schematic depiction of FIG. 3, the plurality of lower receptacles 202-206 may be formed as a single first component 220, the plurality of upper receptacles 208-212 may be formed as a single second component 222, a first vertical component 224 may be formed as a single third component, and a second vertical component 226 may be formed as a single fourth component.

In contrast to the embodiment of FIG. 1 which may be formed as a single piece of material, the structure of FIGS. 2 and 3 may be formed as separate components 220-226. The embodiment of FIGS. 2 and 3 may include a plurality of dividers 228A-228H, where one of the dividers separates each adjacent receptacle 202-212. Dividers 228A, 2280, 228E, and 228H form sides of the retrieval system 200. Lip 230 forms a back of the second component 222.

The first component 220 may include a plurality of grooves or notches 302 on an upper surface of the first component 220 and, in this embodiment, on the dividers 228B, 228C. The notches receive one or more protrusions 304 on a bottom surface of the second component 222 as depicted in FIG. 3 to position and fix the first component 220 relative to the second component 222, for example to prevent horizontal sliding of the second component 222 relative to the first component 220 without the use of an adhesive. The one or more protrusions 304 may be a plurality of separate pegs, or a single continuous ridge extending across a lower surface of the second component 222, that is received by the plurality of grooves 302. In another embodiment, an adhesive (not individually depicted for simplicity) may be used to attach the first component 220 to the second component 222. Each vertical component 224, 226 may include an elongated hook or another attachment structure 306 that allows each vertical component 224, 226 to be removably mounted to one of the walls, lips, or dividers 228E, 228H, 230 of the second component 222. The attachment structure 306 allows each vertical component 224, 226 to be placed at a desired location on the second component 222 of the personal items retrieval system 200, or to be removed completely, by a user.

In each of the depicted embodiments, a height of the dividers 116E-116H. 228E-228H that define the upper receptacles 108-112, 208-212 is less than a height of the dividers 116A-116D, 228A-228D that define the lower receptacles 102-106, 202-206, although other embodiments are contemplated. In the FIG. 1 embodiment, a depth of the upper shelves 108-112 is the same as a depth of the lower shelves 102-16. In the FIG. 2 embodiment, the upper receptacles 208-212 have a first depth and the lower receptacles 202-206 have a second depth, where the second depth is deeper or greater than the second depth. In other words, the front edge of each of the upper receptacles 208-212 is laterally recessed from the front edge of each of the lower receptacles 202-204. Recessing the front edges of the upper receptacles 208 relative to the lower receptacles 202-206 may, for example, improve visual and manual access to items within the lower shelves 202-206. In the FIG. 2 embodiment, however, it will be noted that shelves 208-212 are of a sufficient depth to stably accommodate eyeglasses, a day planner, and cell phone respectively in a lengthwise direction.

The personal organizer 200 as depicted in FIG. 2 includes dividers 228A-228H with rounded exposed edges. The rounded exposed edges may prevent scratches to items as well as a user's hand as items are being placed into or removed from the receptacles 202-212, particularly within the lower receptacles 202-206. Rounded edges may also provide a more esthetically pleasing appearance compared to shelves having square edges.

In the embodiments depicted, widths of the receptacles 202-212 are generally equal, although receptacles 202-212 having different sizes that are each custom designed for the item to be stored is also contemplated. In the embodiment of FIG. 2, each receptacle may have an internal width of from about 4.0 inches to about 5.0 inches, for example about 4.5 inches. Further, a width of each of the first component 220 and the second component 222 may be, for example, from about 13.1 to about 14.1 inches, for example about 13.6 inches. Each lower receptacle 202 may have a depth of from about 6.75 inches to about 7.75 inches, for example about 7.25 inches. Each of the vertically oriented storage containers can have a depth of from about 0.5 to about 0.75 inches, for about 0.67 inches (excluding the attachment structure 306) and a width of from about 4.25 to about 4.75 inches. The personal organizer 100, 200, may have an overall assembled height of from about 3.5 inches to about 4.5 inches, or between about 3.9 inches and about 4.0 inches. Other sizes are contemplated.

Embodiments of the present teachings may provide a visual cue regarding whether a specific personal item is present within the personal items retrieval system. In an embodiment, each receptacle is open such that the presence or absence of the specific personal item can be immediately determined. Thus the depicted embodiments of the personal organizer do not include, for example, a drawer or a door, which would decrease the visibility of the presence or absence of a personal item within the system. Additionally, each receptacle is clearly marked with a label that uniquely identifies the personal item paired with the receptacle. Further, some or most of the bins may be marked for personal items that a user typically only has one of, for example, a cell phone, a wallet, a watch, etc.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising," The term "at least one of" is used to mean one or more of the listed items can be selected. Further in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as on "side" (as in "sidewall"), "higher," "lower," "over," "top," and "under" are defined with respect to the conventional plane or working surface being on the top surface of the workpiece, regardless of the orientation of the workpiece.

The invention claimed is:

1. A personal organizer, comprising:

a first receptacle for receiving a specific first personal item;

a first receptacle label that identifies the specific first personal item;

a second receptacle for receiving a specific second personal item;

a second receptacle label that identifies the specific second personal item a divider that provides a side of the first receptacle and a side of the second receptacle;

at least one vertically oriented storage container, comprising:

one or more vertically oriented slots; and an elongated hook, wherein the at least one vertically oriented storage container is configured to be removably mounted to the the divider using the elongated hook during use of the personal organizer;

a plurality of lower receptacles, each having a ceiling and a front edge; and a plurality of upper receptacles, each having a floor and a front edge, wherein the floor of each upper receptacle is provided by the ceiling of one of the lower receptacles and the front edge of each upper receptacle is horizontally recessed from the front edge of each lower receptacle.

2. The personal organizer of claim 1, wherein the personal organizer is a single piece of material.

3. The personal organizer of claim 2, further comprising:

a plurality of lower dividers, wherein each lower receptacle is separated from an adjacent lower receptacle by a lower divider of the plurality of lower dividers;

a plurality of upper dividers, wherein each upper receptacle is separated from an adjacent upper receptacle by an upper divider of the plurality of upper dividers; and each lower divider is continuous with one of the upper dividers.

4. The personal organizer of claim 1, wherein the personal organizer is a modular personal organizer further comprising:

a first component comprising the plurality of lower receptacles; and a second component comprising the plurality of upper receptacles wherein, during use, the second component is stacked on the first component.

5. The personal organizer of claim 4, further comprising:

a plurality of grooves on an upper surface of the first component; and one or more protrusions on a bottom surface of the second component wherein, during use, the plurality of grooves receive the one or more protrusions.

6. The personal organizer of claim 1, wherein the divider comprises a rounded exposed edge.

7. The personal organizer of claim 1, wherein the first receptacle label and the second receptacle label are alphabetical characters.

8. The personal organizer of claim 1, wherein the first receptacle label and the second receptacle label are graphical labels.

9. The personal organizer of claim 1, wherein the first receptacle and the second receptacle are manufactured from at least one of a translucent and a transparent material.

10. The personal organizer of claim 1, wherein the first receptacle label and the second receptacle label each identify at least one of a wallet, cash, watch, jewelry, keys, eyeglasses, day planner, and cell phone.

11. The personal organizer of claim 10, wherein:

the first receptacle label identifies a cell phone;

the first receptacle comprises a lip that provides a back surface of the first receptacle; and the lip comprises a cell phone cord notch configured to receive and position a cell phone charging cord.

12. The personal organizer of claim 1, further comprising six receptacles and six labels, wherein the six labels identify at least one of a wallet and cash, at least one of a wrist watch and jewelry, and further identifies keys, eyeglasses, a day planner, and a cell phone.

13. The personal organizer of claim 1 further comprising six receptacles and six receptacle labels, wherein the six receptacle labels include indicia that recite “wallet/cash”, “wrist watch/jewelry”, “keys”, “eyeglasses”, “day planner”, and “cell phone”.

* * * * *